United States Patent [19]

Anders

[11] 4,102,144

[45] Jul. 25, 1978

[54] METHOD AND APPARATUS FOR PROTECTING OFFSHORE STRUCTURES AGAINST FORCES FROM MOVING ICE SHEETS

[75] Inventor: Edward O. Anders, Houston, Tex.

[73] Assignee: Global Marine, Inc., Los Angeles, Calif.

[21] Appl. No.: 801,551

[22] Filed: May 31, 1977

[51] Int. Cl.[2] ..... E02B 15/02; B63B 35/44

[52] U.S. Cl. ..... 61/103; 61/1 F; 61/54; 114/40

[58] Field of Search ..... 61/1 R, 102, 101, 103, 61/36 A; 114/40, 41, 42

[56] References Cited

U.S. PATENT DOCUMENTS

| | | | |
|---|---|---|---|
| 3,093,360 | 9/1972 | Holder | 61/1 R X |
| 3,779,019 | 12/1973 | Pogonowski et al. | 61/1 R |
| 3,807,179 | 4/1974 | Stone | 61/1 R |
| 3,831,385 | 8/1974 | Hudson et al. | 61/102 |

*Primary Examiner*—Jacob Shapiro
*Attorney, Agent, or Firm*—Christie, Parker & Hale

[57] ABSTRACT

A stationary offshore platform is protected against damage from moving ice sheets by a conical shield surrounding the platform support structure and having means, such as a pneumatic biasing system, for raising or lowering the shield along the platform support. A system of mooring lines, thrustors, or the like is used to rotate the shield about the platform support. After an advancing ice sheet contacts the narrower upper portion of the shield, the shield is raised so that a wider lower portion of the shield can exert an upward force on the ice sheet to break the ice into pieces. The shield is rotated, while in its elevated position, to carry the broken ice with it to a location downstream from the advancing ice sheet. The shield is then lowered to dump back into the ocean the ice pieces broken by the upstroke of the shield. Means are provided for heating the exterior surfaces of the shield to melt ice pieces sticking to it.

46 Claims, 10 Drawing Figures

METHOD AND APPARATUS FOR PROTECTING OFFSHORE STRUCTURES AGAINST FORCES FROM MOVING ICE SHEETS

BACKGROUND OF THE INVENTION

This invention relates to a method and apparatus for reducing ice forces on offshore platforms or other stationary marine structures installed in waters having moving ice sheets on their surface.

Substantial known reserves of oil and gas exist in Arctic regions, and many of these reserves lie below the surface of the Arctic Ocean or other bodies of water in the Arctic regions. In the past, techniques have been successfully used for tapping offshore oil and gas reserves in sub-Arctic regions by using either offshore platforms erected on the ocean floor, submersible moored drilling platforms, or moored drilling vessels. However, year-round use of these techniques in polar regions can be hazardous because of the ice problem which exists there during much of the year. For example, a permanent polar ice pack exists over much of the Arctic Ocean and varies in extent depending upon the time of year. During the Arctic winter the size of the ice pack expands to positions very close to and in some instances in direct contact with the shoreline. In those areas where the permanent ice pack does not come into direct contact with the shoreline, ice sheets which are fast to or fixed to the shoreline (known as land-fast ice) cover these areas and may extend 25 miles or more offshore.

The permanent ice pack slowly rotates and circulates in the Arctic Ocean, and land-fast ice also moves during the period in which it exists in the Arctic regions. The motion of a land-fast ice sheet is overall in random directions and in random amounts in response to tides, currents, winds and temperature changes. Ice sheets in the Arctic area may move as much as 60 feet per day and can exert substantial forces on a structure such as a drilling or production platform extending through the ice sheet from a supporting connection to the ocean floor. It is very difficult and expensive to construct an offshore structure which can withstand ice forces present in Arctic regions. Hence, there is a need to minimize the forces exerted on offshore structures so that year-round use of conventional offshore drilling engagement in Arctic regions will be possible. It is uneconomical to use conventional offshore drilling equipment in Arctic locations only during the shore ice-free season because of the time and cost involved in moving the equipment into and out of position.

In the past, there have been disclosed a number of proposed solutions to the problem of reducing ice forces on offshore structures. For example, U.S. Pat. No. 3,831,385 discloses a stationary conical shroud surrounding the supporting structure of an offshore drilling platform from the sea floor to above the water surface. The conical shape of the shroud forces advancing ice sheets to ride up on the cone and break flexurally into a number of smaller pieces. The exterior surface of the cone is heated to produce a thin film of melted ice water between the ice and the heated conical surface so that the broken ice pieces will ride up on the cone rather than sticking to it. This system is suitable for relatively slow moving ice sheets, but for ice sheets moving at faster rates, the static cone structure may not break up the advancing ice fast enough to avoid transmitting substantial forces to the structure intended to be protected by the shroud from these forces. The static conical shroud also may not prevent ice broken from faster moving ice sheets from refreezing and accumulating in front of the shroud, which can obstruct the ramp-like surface and prevent the cone from conically breaking the advancing ice sheet. Also, the shroud described in U.S. Pat. No. 3,831,385 is practical only in relatively shallow water depths, and any given shroud structure is useful only in a narrow range of water depths; the shroud is secured to the sea floor to enable it, as compared to the structure it surrounds, to stand against the lateral loads imposed on it as an advancing ice sheet rides up along the conical surface at the waterline.

U.S. Pat. No. 3,779,019 discloses a number of submerged ice-breaking units which are spaced apart around and removed from a marine structure located in an advancing ice field. Each ice-breaking unit can be raised from its submerged location to exert an upward force from below the ice sheet to shatter the ice. However, once the ice is broken, it can refreeze, thereby requiring frequent operation of the several units to maintain reduced ice forces on the marine structure. For fast moving ice sheets, substantial amounts of broken ice pieces can accumulate on the upstream side of the marine structure.

SUMMARY OF THE INVENTION

The present invention protects offshore structures from ice forces by providing a method and apparatus for actively breaking the advancing ice and then, if desired, moving the broken ice to the side of the structure located downstream from the advancing ice sheet. The invention is especially useful in reducing ice forces from fast moving ice sheets by overcoming the problems of refreezing and ice accumulations which hamper the prior art ice-breaking systems described above.

Briefly, the invention includes a movable shield in the form of a wall structure located adjacent a portion of a marine structure in potential contact with a moving ice sheet overlying a body of water. After the advancing ice sheet moves into contact with the shield, the shield is raised to exert an upward force on the ice sheet to break it into pieces. The shield can then be moved, while in its elevated position, to carry the broken ice to a location downstream from the advancing ice sheet to be dumped into the water at the downstream location. Preferably, the shield is lowered into the water to dump the broken ice. The portion of the shield carrying the broken ice can be heated to melt the ice to facilitate dumping it into the water.

In the presently preferred form of the invention, the shield has an exterior surface which tapers upwardly away from the direction of movement of the advancing ice sheet. The shield is initially positioned so that the advancing ice will contact an upper portion of the shield exterior surface. During the upstroke of the shield, a lower portion of the shield surface moves progressively into lifting contact with the adjacent ice and exerts an upward force to break the ice into pieces. The shield surfaces provide a means for carrying the broken ice to the downstream location when the shield is turned about the structure which it surrounds.

Preferably, the shield surrounds the marine structure, and an interior volume of the shield includes an air chamber with means for adjusting the buoyancy of the shield to raise or lower the shield along the marine structure.

In one form of the invention the shield is mounted for upward, downward, or rotational movement independently of any substantial contact with the marine structure sufficient to impose significant loads on the structure. In another form of the invention the upward, downward, and rotational movement of the shield is guided by contact with the marine structure. The shield is not fixed to the sea floor and may have its lower extent well above the sea floor. Thus the present shield can be used in any depth of water, and any given shield can be used in any depth of water. Because the shield is vertically movable relative to the structure which it protects, its mean position at any time can be adjusted in accordance with mean water level at such time to compensate for tidal effects, for example.

BRIEF DESCRIPTION OF THE DRAWINGS

These and other aspects of the invention will be more fully understood by referring to the following description of the presently preferred embodiments of the invention, the description being presented with reference to the accompanying drawings in which.

DETAILED DESCRIPTION OF THE PREFERRED EMBODIMENTS

Figure 1:
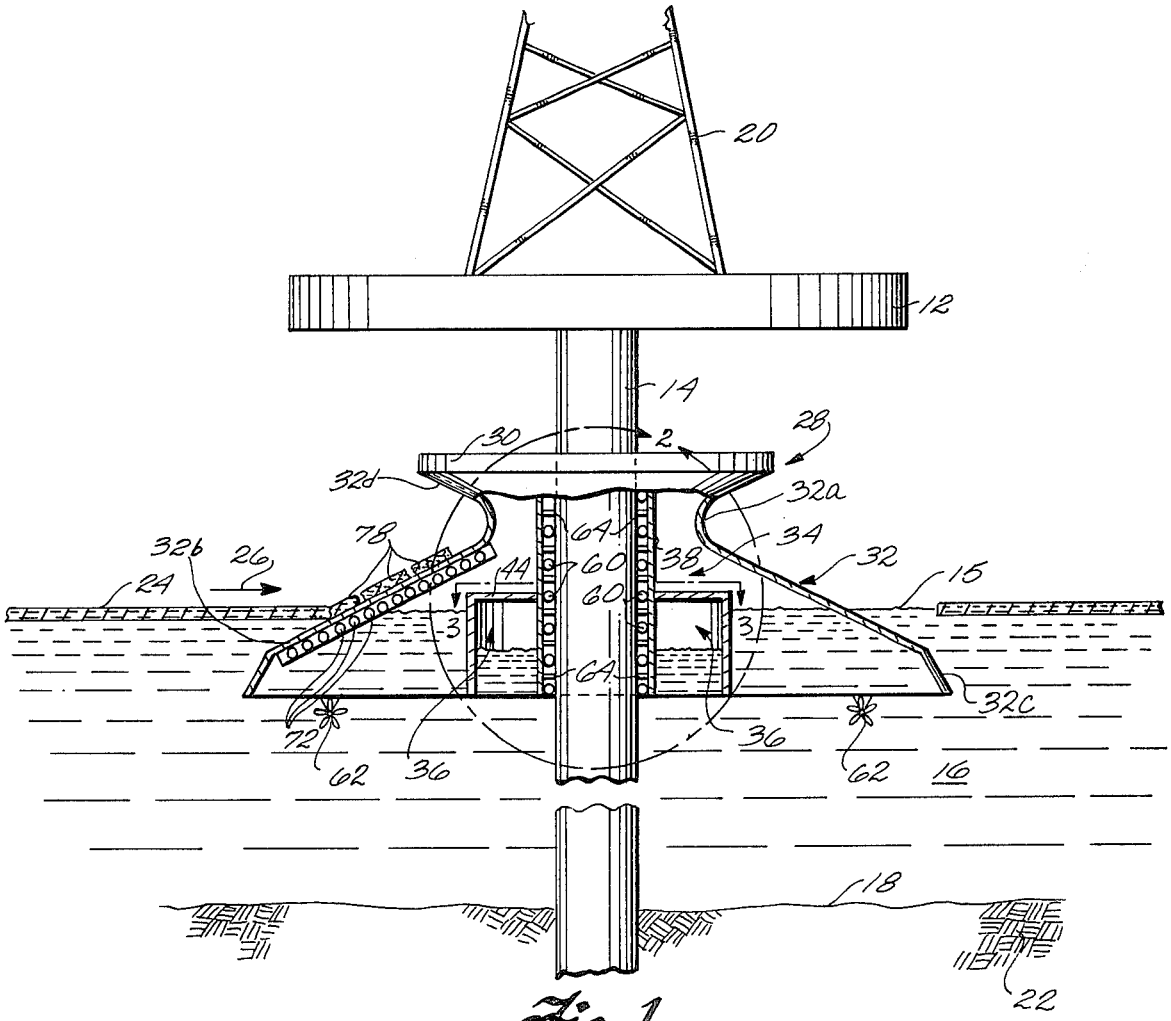
FIG. 1 is a fragmentary cross-sectional elevational view, partly broken away, showing a protective ice-breaking shield according to this invention surrounding an offshore platform located in a body of water covered by a moving ice sheet.
Figure 6:
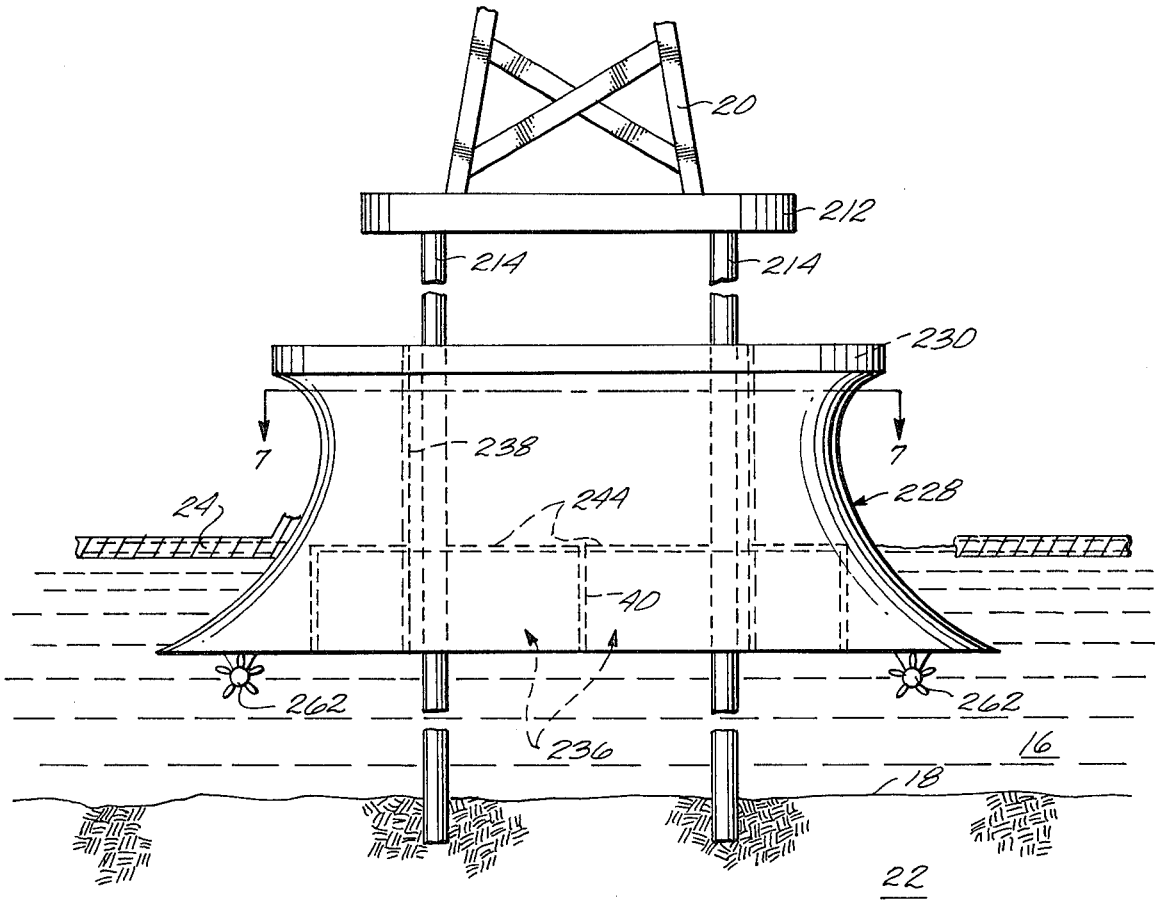
FIG. 6 is a fragmentary cross-sectional elevation view showing the form of ice-breaking shield used to protect an offshore platform having multiple pylons for supporting the platform above the ice.
Figure 7:
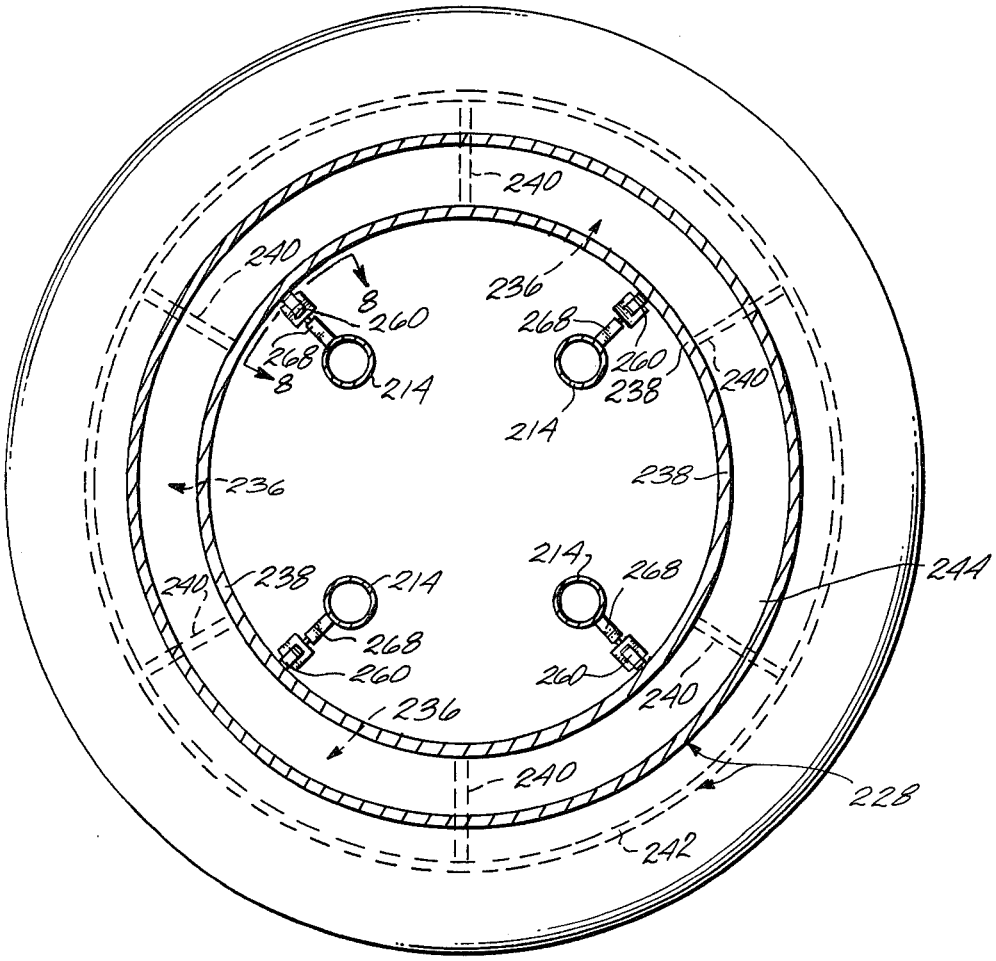
FIG. 7 is a top plan view, partly in cross-section, taken on line 7—7 of FIG. 6.
Figure 8:
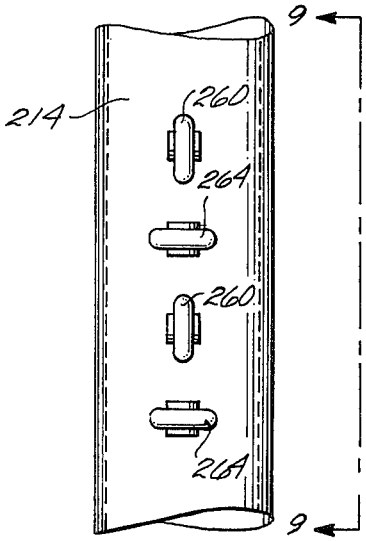
FIG. 8 is a fragmentary elevation view taken on line 8—8 of FIG. 7.
Figure 9:
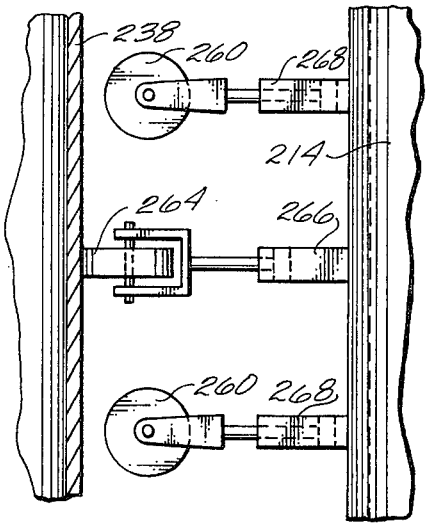
FIG. 9 is a fragmentary elevation view, partly in cross-section, taken on line 9—9 of FIG. 8.

The present invention provides an ice-breaking structure and method which are described in the context of, but which are not limited to, oil and gas exploration, drilling, or production operations in submerged wellsites in Arctic regions. As illustrated in FIG. 1, such operations can be performed from an offshore drilling or production platform 12 having a single upright pylon 14 which supports the platform 12 above the surface 15 of a body of water 16. The bottom of the pylon is anchored to the floor 18 of the body of water. Platform 12 is of the monopod type because its single supporting pylon is anchored directly in the sea floor 18; it will be understood that this invention is not limited to use with single-pylon platforms (compare FIGS. 6 and 7) and that, when used with a single-pylon platform, the platform need not be of the monopod type. For example, a single-pylon platform could have the pylon extending upwardly from a mat structure engaged with and covering a large area of the sea floor, the mat being fixed in place by suitable pilings driven into the subsea geology. Also, as noted below, the platform can be of the semi-submersible type which floats but is anchored in a desired position by anchor cables or chains.

The platform 12 supports an upright derrick 20 and carries equipment for performing desired operations, such as the exploratory or production drilling for oil and gas from a submerged wellsite located in a geological formation 22 below a moving ice sheet 24 at the water surface.

Typically, the ice sheet 24 moves laterally relative to the pylon 14, either constantly or intermittently, and in any direction. For the purpose of this description, it is assumed that the ice sheet 24 is moving toward the pylon 14 in the directon of the arrow 26 shown in FIG. 1. As described in greater detail below, the invention provides means for selectively breaking into pieces that portion of the ice sheet 24 advancing toward the pylon 14 so as to prevent damage to the pylon from impingement forces of the ice sheet.

The present invention provides a movable protective ice-breaking shield 28 which surrounds the portion of the platform, i.e., pylon 14, in potential contact with the advancing ice sheet 24. The shield is spaced radially from the outer surface of the pylon and confronts the moving ice sheet irrespective of the direction from which the ice sheet is moving at any given time. A deck or platform 30 at the top of the shield is located well above the top surface of the ice sheet. The platform 30 provides a means of support for equipment described below for controlling movement of the shield. The shield has an ice-contacting wall structure 32, preferably made of metal, which extends downwardly from the platform 30 into the body of water. The wall structure 32 is primarily conical in shape, tapering downwardly and outwardly from the platform. The exterior surface of the wall structure 32 includes a top section 32*a* which is curved concavely inwardly below the platform 30, an intermediate ramp-like section 32*b* which normally extends along a generally linear slope from well above to well below the zone of potential ice contact, and a lower ramp-like section 32*c* of a steeper slope than the section 32*b*. The upwardly and outwardly sloped shield surface 32*d*, between the minimum diameter of portion 32*a* and deck 30, serves as a deflector of any ice which may be forced high onto ramp section 32*b*. Shield 28 is not connected to the sea floor, and its lower extremities usually are located above the sea floor.

Figure 2:
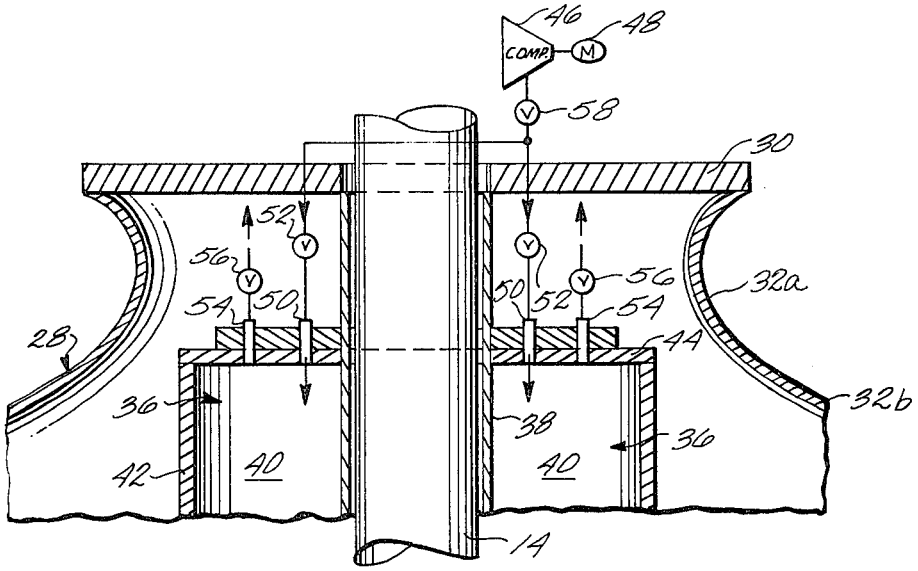
FIG. 2 is a fragmentary, partly schematic, enlarged cross-sectional elevational view of the portion of the shield shown within the circle 2 of FIG. 1.
Figure 3:
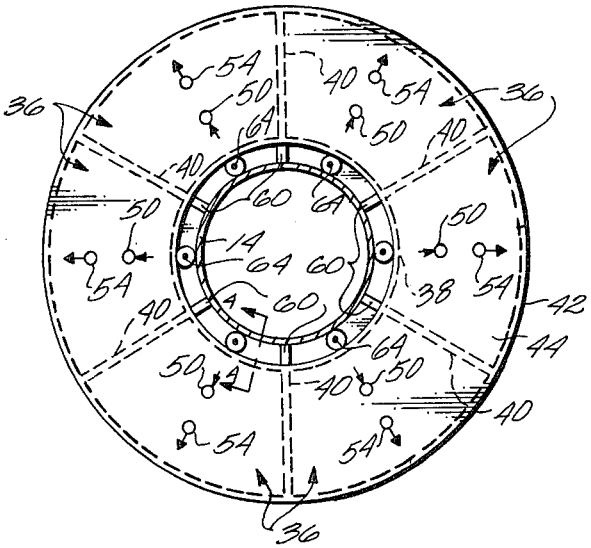
FIG. 3 is a top plan view taken on line 3—3 of FIG. 1.

The conical wall structure 32 is open at its bottom and defines an annular void volume 34 in the interior of the shield. At least a portion of the void volume 34 is occupied by a series of open-bottom air chambers 36 for use in ballasting the shield up and down relative to pylon 14. FIGS. 1 through 3 illustrate the presently preferred arrangement in which six separate air chambers 36 of substantially the same volume are spaced apart circumferentially around the interior of the shield. The inside walls of the air chambers are formed by an upright cylindrical wall structure 38 extending down from the platform 30 and closely surrounding the outside surface of the pylon 14. The individual air chambers 36 are formed by six equidistantly spaced apart, upright bulkheads 40 which extend radially outwardly from the inner wall structure 38 and are joined at their outer ends to an outer upright cylindrical wall 42 which is concentric with the inner wall 38. A horizontally extending, annular bulkhead 44 extends between the inner and outer cylindrical walls to form the upper wall of the individual air chambers 36. The bottoms of the air chambers 36 are open. The total volume of chambers 36 is sufficient that when the chambers are filled with air the total buoyancy of the chambers is sufficient to support the shield in its uppermost position in which the lower edge of shield ramp portion **32*b* is located very close to but below water surface 15**. The shield floats, and its draft is determined principally by its ballast condition at any time.

The floating shield 28 is raised or lowered relative to the pylon 14 by alternately filling the air chambers 36 with air or emptying the air from them to ballast the shield upwardly or downwardly, respectively. The preferred pneumatic system for controlling the buoyancy of the shield is illustrated schematically in FIG. 2. A compressor 46 and a motor 48 for driving the compressor are installed on the platform 30 of the shield. A manifold for regulating air flow to and from each air chamber 36 independently of the other air chambers includes a separate inlet duct 50 extending from the outlet side of the compressor 46 through the top of each chamber bulkhead, a separate throttle valve 52 for each inlet duct, a separate vent duct 54 extending away from the top bulkhead of each chamber, and a separate shut-off valve 56 for each vent duct. A single shut-off valve 58 for the entire pneumatic biasing system is located on the outlet side of the compressor onboard the platform 30.

The shield 28 can be raised by pumping air into the top portion of the air chambers 36 through inlet duct 50s in the chambers. This increases the buoyancy of the shield and causes the shield to move upwardly along the pylon 14. Conversely, the shield can be lowered by venting air from the chambers 36 through the vent ducts 54 to reduce the buoyancy of the shield 28 and cause it to move downwardly along the pylon.

In the embodiments illustrated in FIGS. 1 through 4, the upward and downward movement of the shield 28 is guided along the pylon 14 by several sets of vertically spaced apart, vertically oriented rollers 60 (hereafter call horizontal-axis rollers) located between the outer surface of the pylon 14 and the inside surface of the cylindrical wall structure 38. The respective sets of rollers 60 are spaced apart circumferentially around the outer surface of the pylon 14. In the preferred arrangement illustrated in FIG. 3, the sets of rollers 60 are located at 60° increments around the pylon 14.

The present invention also includes means for rotating the shield about the upright axis of the pylon 14. The embodiment illustrated in FIGS. 1 through 4 includes thrustors 62 projecting below the bottom annular lip of the shield 28 for turning the shield to any rotational orientation relative to the pylon 14.

In the embodiment illustrated in FIGS. 1 through 4, the rotational movement of the shield is guided around the pylon 14 by several sets of vertically spaced apart, horizontally oriented rollers 64 (hereafter called vertical-axis rollers) located between the outer surface of the pylon and the inside surface of the cylindrical wall structure 38. The respective sets of horizontal-axis rollers 64 are spaced apart circumferentially around the outer surface of the pylon. In the preferred arrangement illustrated best in FIG. 3, the sets of horizontal-axis rollers 64 are located at 60° increments around the pylon 14, with each set of horizontal-axis rollers 64 being located equidistantly between adjacent sets of vertical-axis rollers 60. The rollers 60 and 64 can have rubber tires if desired.

Figure 4:
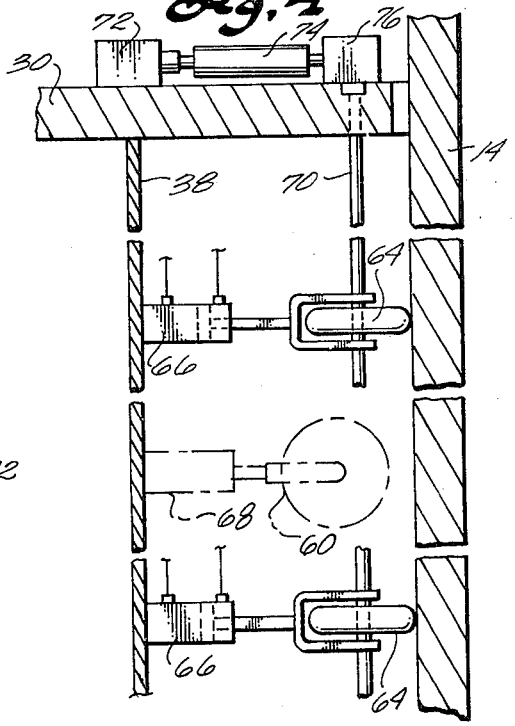
FIG. 4 is a fragmentary, partly schematic cross-sectional elevation view taken on line 4—4 of FIG. 3.

FIG. 4 illustrates a presently preferred system for supporting the horizontal and vertical-axis rollers for reciprocating horizontal movement between the pylon 14 and the shield inner wall structure 38. Preferably, the vertical-axis rollers 64 are supported by sets of corresponding horizontally-positioned double-acting hydraulic rams 66 extending radially between the shield and the pylon; and the horizontal-axis rollers 60 are supported by sets of similarly positioned double-acting rams 68. The rams 66 and 68 are preferably affixed to the shield inner wall structure 38 so the rollers carried by the piston arms of the rams can ride on the outer surface of the pylon 14 when the pistons are extended. The pistons are retracted to move the rollers out of contact with the pylon. As an alternate configuration, the rams 66 and 68 can be affixed to the pylon so that the rollers can ride on the outer surface of the shield inner wall structure 38.

The rams 66 for the vertical-axis rollers are extended or retracted by a hydraulic control system operated by equipment (not shown) onboard the platform 30. A separate hydraulic control system operates the rams 68 for the horizontal-axis rollers 60. The control systems preferably have a cross-connect for alternately extending the rams for the vertical-axis rollers and simultaneously retracting the rams for the horizontal-axis rollers, and vice versa, although the separate sets of rams can be operated independently if desired.

The sets of horizontal and vertical-axis rollers may be used only as idler rollers for guiding the travel of the shield 28 along the pylon, or the rollers also may be used to provide drive means to assist moving the shield relative to the pylon. In the embodiment illustrated in FIG. 4, the vertical-axis rollers 64 act as drive rollers and have their own gear drive mechanism installed on the platform 30. The rollers 64 in each set are mounted on a separate common vertically extending drive shaft 70. Each drive shaft is driven by a separate motor 72 having its output shaft engaged with a spline 74 which, in turn, is connected to a gear box 76 for transmitting torque at right angles between the spline and the drive shaft 70. The spline 74 accommodates the linear retracting and extending motion of the rams 66 for the vertical-axis rollers 64. The surface of the pylon can be roughened or corrugated to provide good traction for the vertical-axis drive rollers 64.

A gear drive mechanism and retractable spline similar to that used for the vertical-axis rollers can be used with the horizontal-axis rollers 60 to assist the pneumatic biasing system in raising or lowering the shield 28, although it is preferred that the horizontal-axis rollers 60 act only as idlers for guiding the upward and downward movement of the shield.

In the preferred method of using the floating ice-breaking shield 28, the air level in the air chambers 36 is initially adjusted so that the conical wall structure 32 of the shield is disposed in the path of the advancing ice sheet 24. Preferably, the ice sheet is allowed to contact the shield near the top of the ramp surface **32*b*. This allows the major portion of the conical wall structure 32 to extend outwardly under the advancing ice sheet 24. The rams 68 are then extended to engage the horizontal-axis rollers 60 with the surface of the pylon 14. The vertical-axis rollers are retracted. The compressor 46 is then operated to pump air through the inlet ducts 50 into the air chambers 36 to increase the buoyancy of the shield 28, which causes the shield to ride upwardly along the pylon. The horizontal-axis rollers 60 guide the upward travel of the shield along the pylon. The upward movement of the shield causes the outwardly projecting lower portion of the shield wall structure 32** to apply an upward force against the bottom of the ice sheet to progressively break into pieces that portion of the advancing ice sheet which is closest to the pylon. For relatively thin ice sheets, the shield may be frequently raised to break the ice and then lowered in preparation for next upstroke.

For relatively thick ice sheets, the broken ice can be carried away from the shield/ice interface. The lower portion of the shield wall is configured so that it will provide a means of support for the ice pieces broken by it during the upstroke of the shield. When the broken ice is to be carried away from the shield/ice interface, the shield is maintained in its elevated position after breaking the ice so that the broken ice pieces, illustrated at 78 in FIG. 1, will stick to the outer surface of the conical shield structure 32. In most instances, the broken ice pieces will naturally stick to the exposed shield surfaces, since the ambient air temperature will be sufficiently low enough to chill the shield surfaces and to cause the ice pieces to freeze to the shield. If ambient air temperature cannot be relied on to freeze the ice pieces to the raised shield, the inner surfaces of the ramp portions of the shield, at least in that portion of the shield facing toward the advancing ice, can be artificially refrigerated to cause the ice pieces to freeze to the shield as the shield is raised.

While the shield is in its elevated position, the rams 68 are retracted and the rams 66 are simultaneously extended to retract the horizontal-axis rollers 60 and to engage the vertical-axis rollers 64 with the outer surface of the pylon 14. The thrustors 62, together with the vertical-axis rollers 64 (if used as drive rollers), are then operated to rotate the shield around the pylon, preferably through an arc of about 180°. This moves the broken ice pieces 78 to a location downstream from the instantaneous direction in which the ice sheet is advancing. The ice pieces which have been broken during the upstroke of the shield are then dumped back into the ocean at the downstream location. The ice is preferably dumped by operating the pneumatic biasing system so as to vent air from the air chambers 36 through the vent ducts 54 to ballast the shield 28 downwardly along the pylon 14. Preferably, most of the shield structure is submerged in the body of water to aid in dumping the broken ice pieces back into the ocean.

The interior of the shield preferably includes a series of heating channels 72 for transferring heat to the exterior surface 32 of the shield to melt the bond between the broken ice pieces and the shield surface so as to facilitate dumping the ice pieces into the water. The multiple heating channels 72 are in contact with the inside surface of the shield opposite the ramp-like exterior surface **32*b*. Preferably, the shield is heated by circulating a heating fluid at a temperature above the melting temperature of the ice through the heating channels 72 and into direct contact with the inside surface of the shield structure 32. This heats the exterior of the shield sufficiently to produce a thin film of melted ice water between the broken ice pieces 72** and the shield so that the ice pieces slide down the shield and into the water.

As illustrated best in FIG. 1, the heating channels 72 need not extend around the entire inside surface area of the shield. That is, the shield can be rotated approximately 180° away from its upstream position to dump the broken ice piecs and then rotated back to its initial position facing in the upstream direction. The thrustors 62 can be used to turn the shield to any angular orientation in which the same portion of the shield always confronts the advancing ice sheet. Since only that portion of the shield which actually works to break ice need be heated to melt broken ice pieces, only approximately 200° of the arc of the shield needs to be covered by the heating channels 72.

Figure 5:
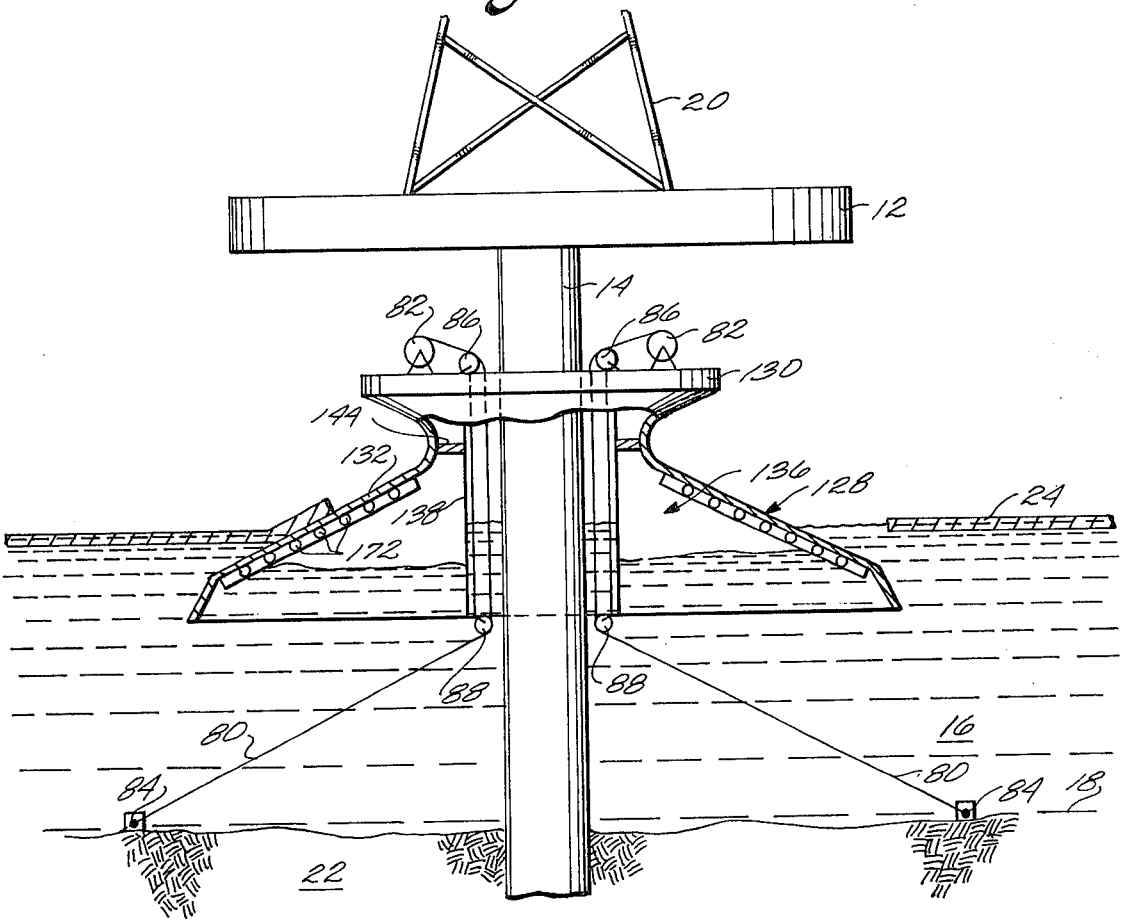
FIG. 5 is a fragmentary cross-sectional elevation view, partly broken away, showing an alternate form of the protective shield.

FIG. 5 illustrates another ice-breaking shield 128 which is supported for upward, downward and rotational movement independently of the pylon 14. In the form of the invention, the surface structure of the shield is substantially identical in shape to that of the shield 28. The separate air tanks 36 described above are replaced in the shield of FIG. 5 with a single continuous annular air chamber 136. The top of the air chamber 136 is formed by an annular bulkhead 144 extending around the inside of the shield. The shield 128 is held in place around the pylon 14 by a mooring system which includes separate mooring lines 80 extending away from corresponding winches 82, which preferably have a constant-tension operating mode, onboard the shield platform 30. The mooring lines 80 extend radially outwardly and downwardly from the shield 128 at equidistantly spaced apart intervals to respective anchors 84 on the ocean floor. Each mooring line 80 extends from its respective winch 82 around a sheave 86 located onboard the shield platform 130, and then down through the central opening in the shield adjacent the pylon, around a fairlead sheave 88 located at the bottom of the central opening in the shield, and then to the anchor 84.

During use of the shield 128, air is pumped into or vented from the air chamber 136 to raise or lower the shield, respectively, relative to the pylon 14. The mooring lines 80 and sheaves 86, 88 guide the shield vertically up or down relative to the pylon. When dumping broken ice pieces at a downstream location, the shield can be rotated about the pylon 14 by adjusting the effective lengths of the mooring lines 80 so as to swing the shield through a 180° arc to the downstream location. After the ice is dumped into the ocean, the mooring lines 80 are then used to swing the shield back to its initial position so as to unwind the mooring lines. Anchors 84 are disposed in an appropriate pattern such that, by taking in some and paying out others of the mooring lines, the shield can be turned in either direction a selected amount about pylon 14,.

In the form of the shield shown in FIG. 5, the entire inside surface area of the shield in the vicinity of the ramp-like surface 132 is covered with heating channels 172 to heat any portion of the shield surface which contacts an advancing ice sheet. The system for heating the surface of the shield 128 preferably includes means for circulating heating fluid to selected heating channel sections so that selected areas of the shield outer surface may be heated at any given time.

The system of mooring lines 80 supports the shield 128 about the pylon independently of any substantial contact with the pylon. This system has the advantage of preventing lateral overturning loads from being transmitted to the pylon 14 by ice sheets contacting the shield. As an alternative, however, the shield 128 also can be used with vertical and horizontal axis idler rollers (not shown) between the inside wall 138 of the shield and the outside surface of the pylon 14 to provide means for guiding the vertical and rotational movement of the shield along the pylon.

FIGS. 6 through 9 illustrate another ice-breaking shield 228 mounted on an offshore platform 212 supported by multiple upright platform legs 214. In this form of the invention, the conical shield structure has an exterior ice-contacting surface configuration similar to that of shields 28 and 128 described above. The shield structure 228 is shown extending around all of the platform legs 214, although it will be understood that a separate shield could be used on each leg 214, or that a single shield could be used on more than one, but not necessarily all, of the legs supporting the offshore structure. The shield 228 is raised or lowered by regulating the flow of air to separate air chambers 236 located in the interior of the shield in much the same manner as the air chambers 36 for the shield illustrated in FIGS. 1 through 4. The shield 228 is rotated around the multiple platform legs 214 by thrustors 262 located on the bottom of the shield, although a mooring system similar to that shown in FIG. 5 may also be used. The platform legs 214 have outwardly extending horizontal-axis idler rollers 260 for guiding the upward and downward movement of the shield 228 relative to the platform legs. The platform legs also have vertical-axis idler rollers 264 for guiding the rotational movement of the shield relative to the platform legs. Preferably, the horizontal-axis guide rollers can be extended into contact with the shield inner wall 238 or retracted from contact with the wall by respective hydraulic rams 268 attached to each of the platform legs 214. Similarly, the vertical-axis rollers 264 can be extended or retracted by respective hydraulic rams 266 also attached to the platform legs 214. The hydraulic system for controlling the hydraulic rams preferably includes a cross-connection for simultaneously extending the horizontal-axis rollers and retracting the vertical-axis rollers during vertical movement of the shield, while the horizontal-axis rollers are retracted and the vertical-axis rollers are extended during rotational movement of the shield around the platform legs 214.

Figure 10:
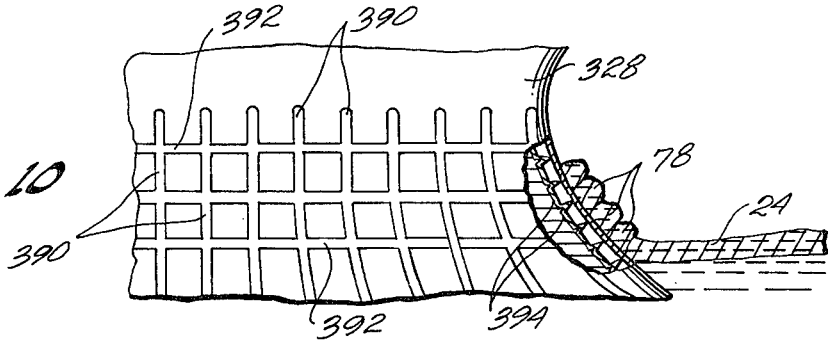
FIG. 10 is a fragmentary schematic elevation view showing a means for increasing heat transfer between the protective shield and the ice.

Ice in contact with the protective shield can be heated by the heat transfer system illustrated in FIG. 10. This means for heating the shield can be used in situations where it is necessary to increase the rate of heat transfer to the ice when compared with the static heating techniques described above. In the system illustrated in FIG. 10, the outer surface of the shield 328 is grooved and a heating fluid is circulated into direct contact with the inner surface of the shield opposite the grooves according to the techniques disclosed in U.S. patent application Ser. No. 609,030, filed Aug. 29, 1975, and assigned to the assignee of this application. According to the principles of those techniques, the outer surface of the shield 328 includes a series of horizontally spaced apart, upwardly extending, parallel grooves 390 covering the portion of the shield surface in potential contact with the ice. The shield also can include a series of horizontally extending, parallel grooves 392 which intersect the upward grooves 390. The weight of the ice pieces on the shield applies force to the grooved surface of the shield. Heating channels 394 inside the shield are used to circulate a heating fluid into direct contact with the inside of the grooved shield surface to direct heat outwardly from the shield to the ice. This arrangement increases the rate of heat transfer to the ice.

Thus, the present invention protects stationary offshore structures from ice forces by actively breaking the advancing ice sheet at any time it is necessary to prevent significant ice loads from being exerted on the offshore structure. The invention also removes ice immediately after it is broken, which prevents refreezing of the ice, or substantial accumulations of broken ice pieces on the upstream side of the offshore structure. This keeps the structure substantially free from overturning loads being imposed on it even when subjected to relatively fast-moving ice sheets; it also reduces the number of times the ice breaker must be operated in a given installation to keep the structure relatively free from ice forces.

It will be understood, also, that the shields described above can be used in a static member when the moving ice sheet is relatively thin, or weak.

It will be further understood that the marine structure protected by the shield need not include a support fixed to the ocean floor, but may also be used to protect a semisubmersible platform, or the like, as well.

From the foregoing description it will be seen that an ice-breaking shield structure according to this invention has many advantages. Because it is functionally separate from the structure which it protects, and can also be physically separate, it can be used with existing offshore drillling platforms to adapt the platforms for use in ice covered waters. The shield is not fixed to the sea floor, and thus can be used in water of any depth. The shield does not rely on an ability to stand against the movement of ice toward it to cause the ice to ride upwardly against and alon its sloping ice-breaking surfaces, and it therefore can be free of any connection to the sea floor. Instead, the shield itself moves upwardly against the ice. In use, substantial loads are applied only vertically to the shield rather than horizontally, and such loads are buoyantly supported. Since the shield is floating, it adjusts automatically to changes in water level due to tides. Also, because it floats and adjusts to tidal effects, the present shield has an overall height of its sloped ice-breaking surface which is defined principally in terms of the maximum thickness of ice to be broken and the amount of ice to be broken in any given upward motion of the shield. Contrast this last feature with the overall height of the ice-breaking surface of a stationary shield, such as that described in U.S. Pat. 3,831,385, is much greater because the upper and lower limits of the slope must be vertically spaced a distance at least equal to, and preferably greater than the vertical distance between maximum high and low tides.

The foregoing description has been presented for the purposes of illustration and example, rather than as an exhaustive catalog of all forms in which the invention can be embodied. Therefore, the following claims are to be read in their broadest light in accordance with the fair teachings of the preceding description, rather than in a restricted or literal manner.

What is claimed is:

1. A method for protecting a marine structure fixed in a body of water from forces exerted by sheet ice moving across the water surface comprising the steps of:

placing adjacent the marine structure a shield surface which slopes away from the structure in a direction opposite to the direction of ice movement from the structure proceeding from an upper portion above the water surface to a lower portion disposed below the water surface, allowing a portion of the sheet ice to move substantially into contact with the shield surface so that a submerged portion of the shield surface is disposed below the ice, raising the shield surface to an elevated position thereof to cause the surface to lift the ice and to break pieces therefrom, and moving the shield surface in the elevated position thereof to a position thereof downstream from the marine structure relative to the direction of ice movement.

2. The method of claim 1 including carrying on the shield surface pieces of ice broken during the raising step to the downstream position of the shield surface, and discharging the carried ice pieces from the shield surface at the downstream position.

3. The method of claim 1 including lowering the shield surface at the downstream position thereof to substantially its unraised elevation relative to the marine structure.

4. The method according to claim 1 including carrying on the shield surface pieces of ice broken during the raising step to the downstream position of the shield surface, and discharging the carried ice pieces from the shield surface by lowering the shield into the water at the downstream position.

5. The method according to claim 4 including heating the surface of the shield while in the downstream position to melt broken ice pieces adhering to the shield surface.

6. The method according to claim 1, including heating the surface of the shield while in the downstream position to melt broken ice pieces adhering to the shield surface.

7. The method according to claim 1 including adhering the broken ice pieces to the surface of the shield prior to moving the shield to facilitate carrying the ice pieces on the shield surface to the downstream position.

8. The method according to claim 1 including moving the shield to the downstream position by rotating the shield about the marine structure.

9. The method according to claim 4 including adjusting the buoyancy of the shield to raise or lower the shield relative to the marine structure.

10. The method according to claim 9 including heating the surface of the shield while in the downstream position to melt broken ice pieces adhering to the shield surface.

11. Apparatus for protecting a marine structure fixed in a body of water and extending above the surface thereof from forces exerted by a moving ice sheet at the water surface comprising:

a shield adapted to be positioned adjacent the marine structure and having a sloping working surface, the shield being vertically movable between an elevated position and a lowered position in which the working surface extends from an upper portion thereof above the water surface downwardly away from the marine structure to a lower portion thereof disposed below the water surface, the shield also being movable laterally between an upstream position and a downstream position of the working surface relative to the marine structure in terms of the direction of ice movement, means for raising the shield from its lowered to its elevated position in the upstream position of the shield, the shield during such raising being adapted to engage and to lift and to break ice disposed above the working surface, and means connectible to the shield operable for moving the shield in the elevated position thereof from its upstream position to its downstream position.

12. Apparatus according to claim 11 in which the working surface of the shield is arranged to support pieces of ice broken during raising of the shield so as to carry the ice pieces on the shield to the downstream position.

13. Apparatus according to claim 12 including means for heating at least the working surface of the shield to discharge ice pieces adhering to the shield.

14. Apparatus according to claim 12 including means for lowering the shield from said elevated position to a lowered position in which the working surface of the shield is disposed below the water surface to discharge adhering ice pieces into the water.

15. Apparatus according to claim 14 including means for heating at least the working surface of the shield to facilitate discharging adhering ice pieces from the shield.

16. Apparatus according to claim 14 in which the marine structure includes an upright support extending through the water surface; and including means for guiding movement of the shield via the upright support.

17. Apparatus according to claim 10 including roller means engaged between the shield and the upright support for guiding the raising and lowering movement of the shield and for guiding movement of the shield between its upstream and downstream positions.

18. Apparatus according to claim 14 in which the shield is buoyant; and including means for adjusting the buoyancy of the shield to raise and lower the shield relative to the marine structure.

19. Apparatus according to claim 18 including a floodable chamber carried by the shield; means for removing water from the chamber to increase the buoyancy of the shield to raise the shield; and means for flooding the chamber to reduce the buoyancy of the shield to lower the shield.

20. Apparatus according to claim 18 including drive means engageable between the marine structure and the shield to assist elevating the shield relative to the support structure.

21. Apparatus according to claim 11 in which the means for moving the shield between the upstream and downstream positions includes means arranged to rotate the shield about the marine structure.

22. Apparatus according to claim 21 in which the shield rotating means includes a plurality of thrustors on the shield.

23. Apparatus according to claim 21 in which the shield rotating means includes drive means engageable between the shield and the marine structure for rotating the shield about the marine structure.

24. Apparatus according to claim 21 in which the shield rotating means includes mooring lines extending from the shield to anchor means on the bottom of the body of water, and means on the shield for adjusting the effective lengths of the mooring lines to rotate the shield about the marine structure.

25. Apparatus according to claim 24 in which the mooring line means are operable to turn the shield in either direction of rotation about the marine structure.

26. Apparatus according to claim 24 in which the mooring line means are operable to cause the shield to face in any desired direction away from the marine structure.

27. Apparatus according to claim 14 including means for raising or lowering the shield or for moving the shield between its upstream and downstream positions independently of any substantial forceful contact with the marine structure.

28. Apparatus according to claim 27 including mooring lines extending from the shield to anchor means below the body of water, and means for adjusting the effective lengths of the mooring lines.

29. Apparatus according to claim 11 in which the shield has a vertical axis of symmetry, and including means connected to the shield and operable for rotating the shield in the elevated position thereof about the vertical axis of symmetry to a position in which the working surface is downstream, in terms of the direction of ice movement, from the marine structure.

30. Apparatus according to claim 14 including means for guiding movement of the shield by contact with the marine structure.

31. Apparatus according to claim 30 including roller means engaged between the marine structure and the shield for guiding the raising and lowering movement of the shield and for guiding movement of the shield between its upstream and downstream positions.

32. Apparatus according to claim 31 in which the roller means include vertical-axis rollers for guiding rotational movement of the shield relative to the marine structure.

33. Apparatus according to claim 31 in which the roller means include horizontal-axis rollers for guiding vertical movement of the shield relative to the marine structure.

34. Apparatus according to claim 32 in which the roller means include horizontal-axis rollers for guiding vertical movement of the shield relative to the marine structure.

35. Apparatus according to claim 34 including means for moving the vertical and horizontal-axis rollers into or out of engagement between the shield and the marine structure.

36. Apparatus according to claim 11 including selectively operable means for heating selected areas of the shield surface.

37. Apparatus according to claim 12 including means for artificially refrigerating the shield surface to adhere broken ice pieces to the shield.

38. In combination with a marine structure fixed in a body of water and having an upright support extending through the water surface, appartus for reducing forces exerted on the support by a moving ice sheet at the water surface, the apparatus comprising:

a vertically movably shield surrounding the support, the shield having a sloping working surface extending, in a lowered position thereof, from above the water surface downwardly away from the marine support, at least in a direction opposite to which the ice is moving toward the support, to a lower position disposed below the water surface;

means for normally positioning the shield in a position thereof facing upstream, in terms of ice movement, so the working surface lower portion projects below the moving ice sheet;

a floodable chamber in the shield and means for removing water from the chamber to increase the buoyancy of the shield for raising the shield to an elevated position in which the lower portion of the shield working surface is disposed below the water surface, the shield during raising thereof being adapted to engage and to lift and to break ice disposed above the working surface, the lower portion of the shield surface being configured to support broken ice pieces adhering to the shield surface;

means for rotating the shield about the support, while the shield is in the elevated position, to move the working surface of the shield downstream, in terms of direction of ice movement, from the marine structure support so that broken ice pieces can be carried on the shield surface to the downstream position; and means for flooding the chamber to lower the shield from its elevated position to discharge the broken ice into the water at said downstream position.

39. Apparatus according to claim 38 including means for heating at least the working surface of the shield to melt broken ice in contact with the shield.

40. Apparatus according to claim 39 including means for guiding movement of the shield via contact with the marine support.

41. Apparatus according to claim 40 including roller means engaged between the shield and the support for guiding movement of the shield vertically and for guiding rotational movement of the shield between its upstream and downstream positions.

42. Apparatus according to claim 41 including means for selectively engaging the roller means or for retracting the roller means from engagement between the shield and the support.

43. A marine structure located in a fixed position in a body of water having a moving ice sheet at the surface of the water, the marine structure comprising:

a platform located above the surface of the water;

an upright support member extending through the water surface and supporting the platform above the water;

a vertically movable shield adapted to be positioned adjacent the marine support and having a sloping working surface extending, in a lowered position thereof, from above the water surface downwardly away from the support, at least in a direction opposite to which ice is movable toward the support, to a lowered position disposed below the water surface;

means for raising the shield to an elevated position in which the lower portion of the shield working surface is disposed below the water surface, the shield during raising thereof being adapted to engage and to lift and to break ice disposed above the working surface, the working surface being configured to support pieces of ice broken during raising of the shield;

means connected to the shield and operable for moving the shield in the elevated position thereof to a position of the working surface downstream, in terms of the direction of ice movement, from the marine structure; and means for lowering the shield to a lowered position in which the working surface is submerged in the water to facilitate discharging the broken ice pieces from the shield surface in the downstream position.

44. A marine structure according to claim 43 in which the marine structure is of single pylon configuration.

45. A marine structure according to claim 43 in which the platform is supported by an array of plural upright supports which extend through the water surface, and the shield surrounds the array.

46. A marine structure according to claim 45 including roller means provided between at least some of the supports and the sield for guiding vertical and rotational movement of the shield relative to the supports.

* * * * *

UNITED STATES PATENT AND TRADEMARK OFFICE

CERTIFICATE OF CORRECTION

PATENT NO. : 4,102,144

DATED : July 25, 1978

INVENTOR(S) : Edward O. Anders

It is certified that error appears in the above-identified patent and that said Letters Patent are hereby corrected as shown below:

Column 1, line 46, for "engagement" read -- equipment --; line 49, for "shore" read -- short --. Column 2, line 5, for "conically" read -- continually --. Column 3, line 22, for "elevational" read -- elevation --; line 29, for "elevational" read -- elevation --. Column 5, line 64, for "horizontal" read -- vertical --; line 67, for "horizontal" read -- vertical --. Column 6, line 1, for "64" read -- 60 --; line 3, for "60" (first occurrence) read -- 64 --. Column 8, line 5, for "piecs" read -- pieces --; line 16, for "the" (second occurrence) read -- this --. Column 10, line 16, for "member" read -- manner --; line 27, for "drillling" read -- drilling --. Column 12, line 27, for "10" read -- 16 --. Column 13, line 19, for "14" read -- 11 --; line 51, for "appartus" read -- apparatus --. Column 16, line 2, for "sield" read -- shield --.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*